US010889145B2

(12) United States Patent
Stapleton

(10) Patent No.: US 10,889,145 B2
(45) Date of Patent: Jan. 12, 2021

(54) PAINT BRUSH SUSPENSION LID

(71) Applicant: Jeremy Stapleton, Nanaimo (CA)

(72) Inventor: Jeremy Stapleton, Nanaimo (CA)

( * ) Notice: Subject to any disclaimer, the term of this patent is extended or adjusted under 35 U.S.C. 154(b) by 0 days.

(21) Appl. No.: 15/887,964

(22) Filed: Feb. 2, 2018

(65) Prior Publication Data

US 2018/0215196 A1 Aug. 2, 2018

Related U.S. Application Data

(60) Provisional application No. 62/453,862, filed on Feb. 2, 2017.

(51) Int. Cl.
*B44D 3/12* (2006.01)

(52) U.S. Cl.
CPC ..... *B44D 3/123* (2013.01); *B44D 3/127* (2013.01)

(58) Field of Classification Search
CPC ..... B44D 3/123; B44D 3/127; B44D 3/12; B44D 3/126; B65D 51/32
USPC ..... 220/697, 699, 700, 701
See application file for complete search history.

(56) References Cited

U.S. PATENT DOCUMENTS 2,436,291 A * 2/1948 Daniel ..... B65D 51/24 15/257.05
4,771,501 A * 9/1988 Leiter ..... B44D 3/121 15/104.92
5,893,489 A * 4/1999 Giarrante ..... B44D 3/127 220/254.8
5,975,346 A * 11/1999 Imperato ..... B44D 3/123 220/284
6,264,072 B1 * 7/2001 Johannes ..... B44D 3/12 222/460
2002/0125248 A1 * 9/2002 Montgomery ..... B65D 39/0088 220/203.13
2003/0052128 A1 * 3/2003 Cheever ..... B44D 3/12 220/259.1
2014/0175104 A1 * 6/2014 Leonard ..... B44D 3/127 220/735
2015/0165817 A1 * 6/2015 Alvares ..... B65D 25/24 220/790
2017/0267409 A1 * 9/2017 Hudson ..... B44D 3/127
2017/0355487 A1 * 12/2017 Guertin ..... B65D 15/08

* cited by examiner

*Primary Examiner* — Shawn M Braden

(74) *Attorney, Agent, or Firm* — Island IP Law; Stephen R. Burri

(57) ABSTRACT

A paint brush suspension lid for a paint can which incorporates a resilient brush holder insert designed to hold a paint brush handle at a desired static vertical position, enabling the bristles to be immersed in the paint without touching the bottom or sides of the paint can, thereby protected from the ambient air when not in use, without damaging the paint brush by immersing the brush ferrule. The lid is a bright coloured, high visibility material evocative of a caution cone, and is shaped to permit unobstructed use of a paint can handle while the lid is in place atop the can.

10 Claims, 9 Drawing Sheets

PAINT BRUSH SUSPENSION LID

FIELD OF THE INVENTION

The present invention relates to the painting industry. In particular, the present invention relates to a paint brush suspension lid device for preservation of paint brushes and paint products.

BRIEF DESCRIPTION OF THE DRAWINGS

A detailed description of the preferred embodiments is provided below by way of example only and with reference to the following drawings, in which.

Figure 1:
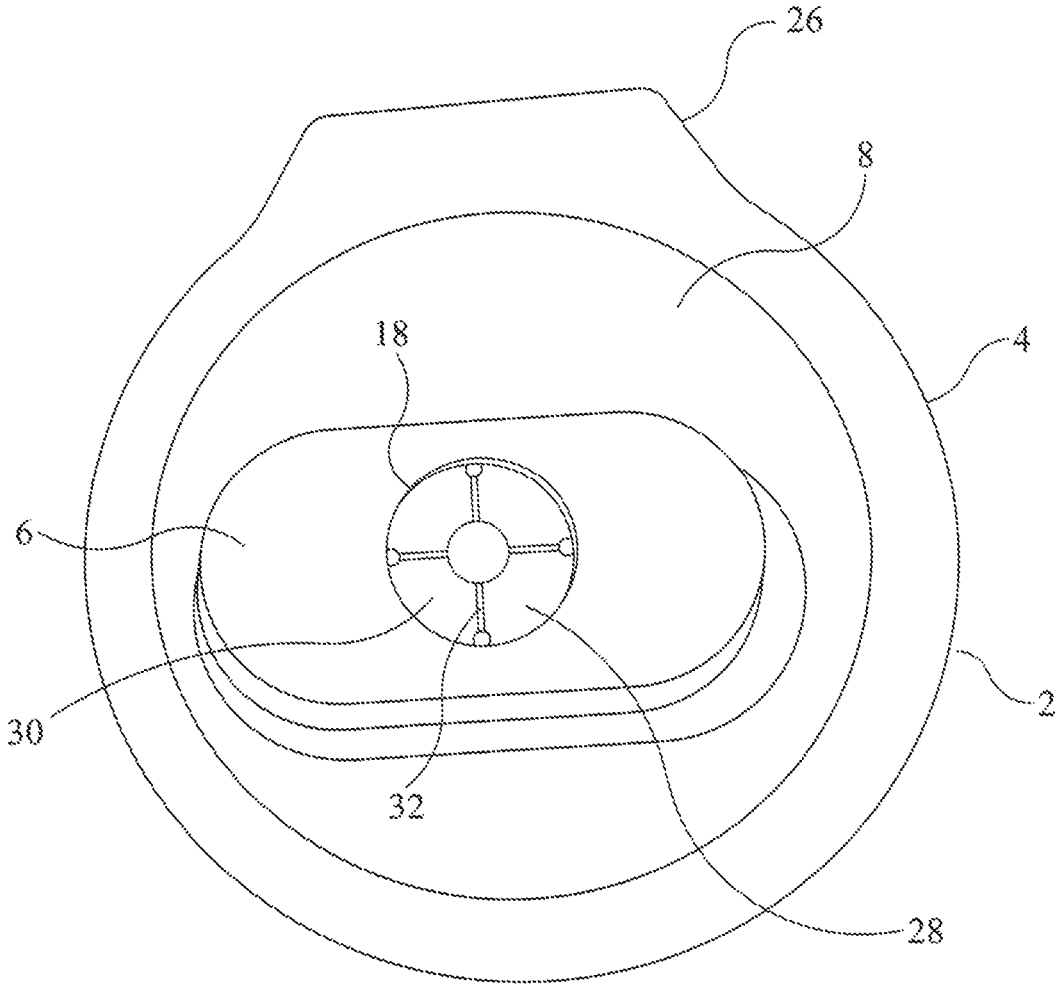
FIG. 1 depicts a top plan view of a preferred embodiment of the device of the present invention.
Figure 2:
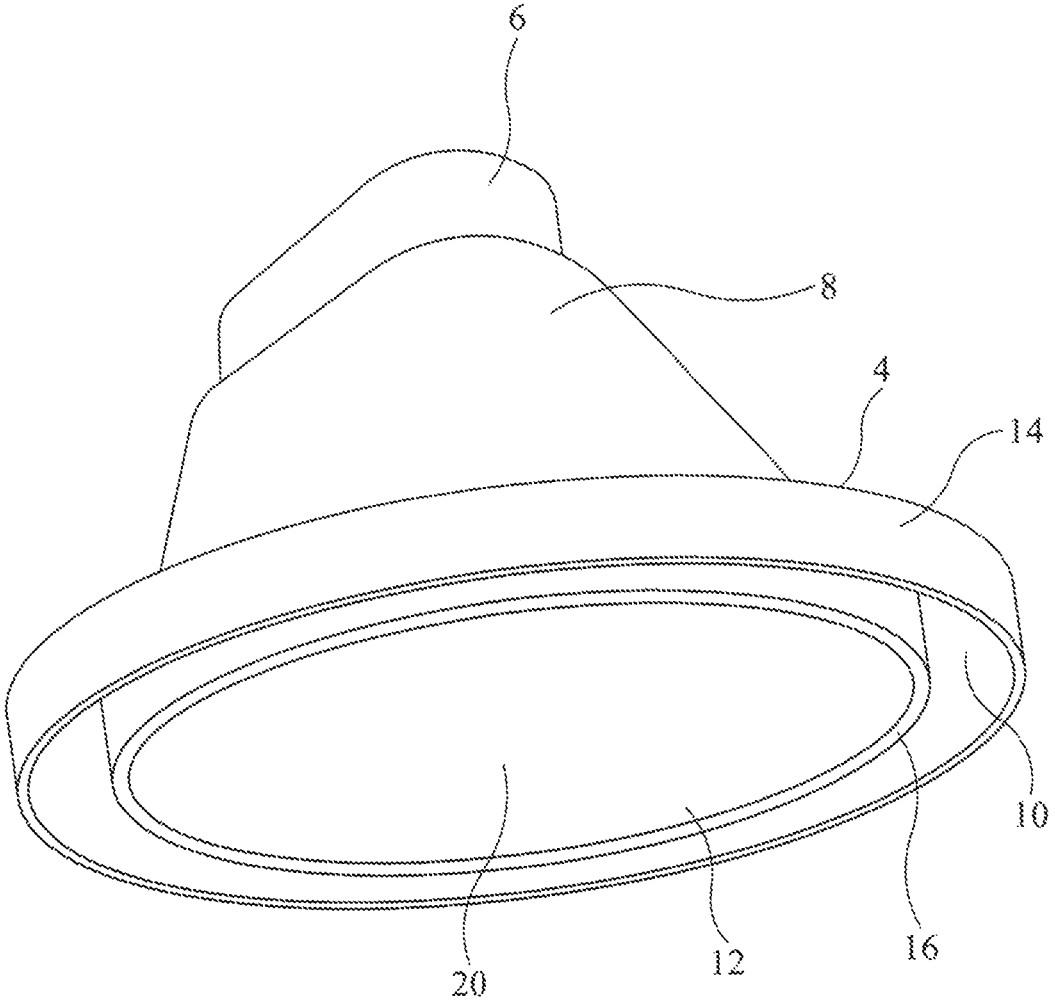
FIG. 2 depicts a bottom perspective view of the preferred embodiment of the device of the present invention.
Figure 3:
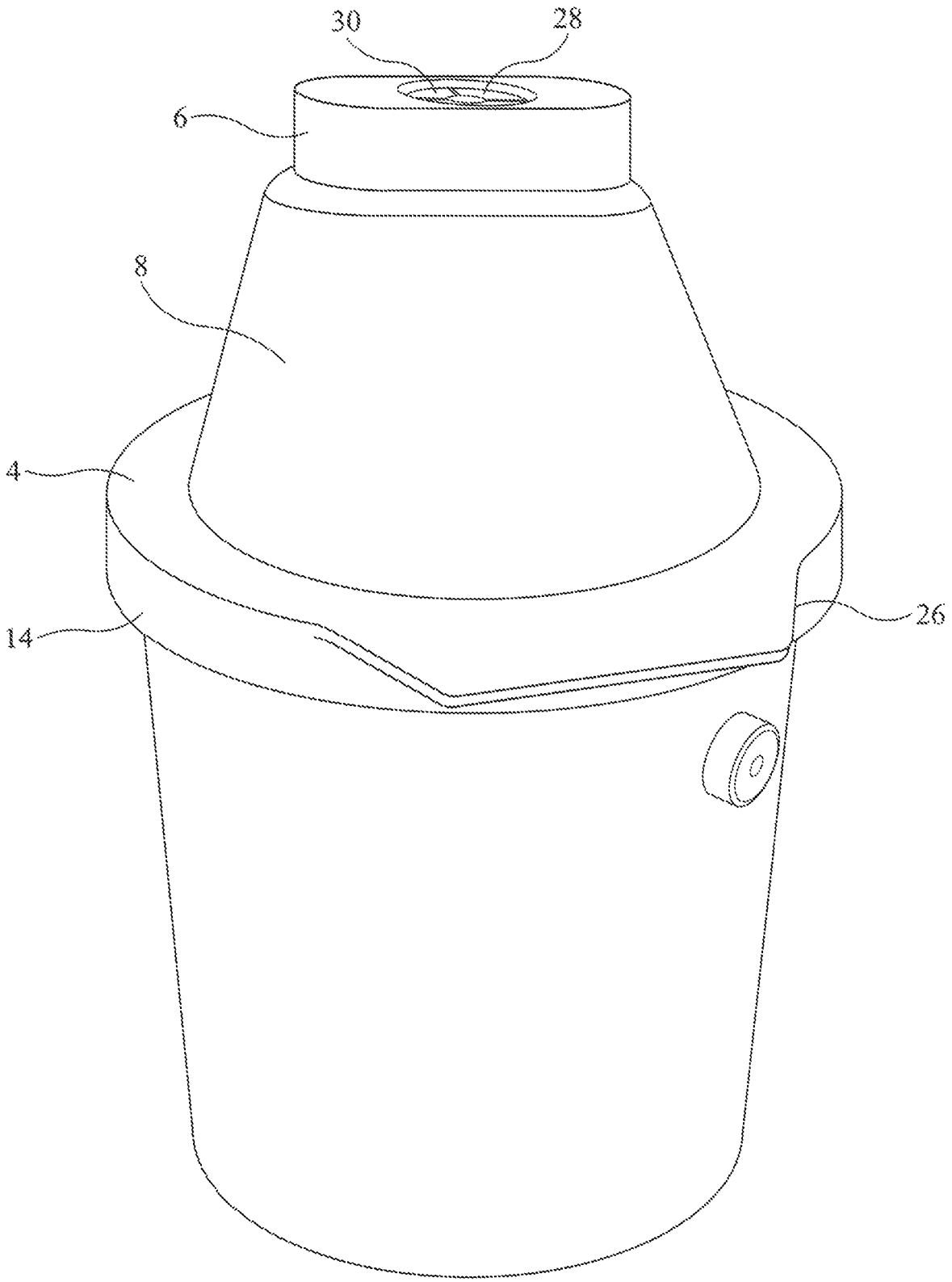
FIG. 3 depicts a top perspective view of the preferred embodiment of the device of the present invention attached to a paint can.
Figure 4:
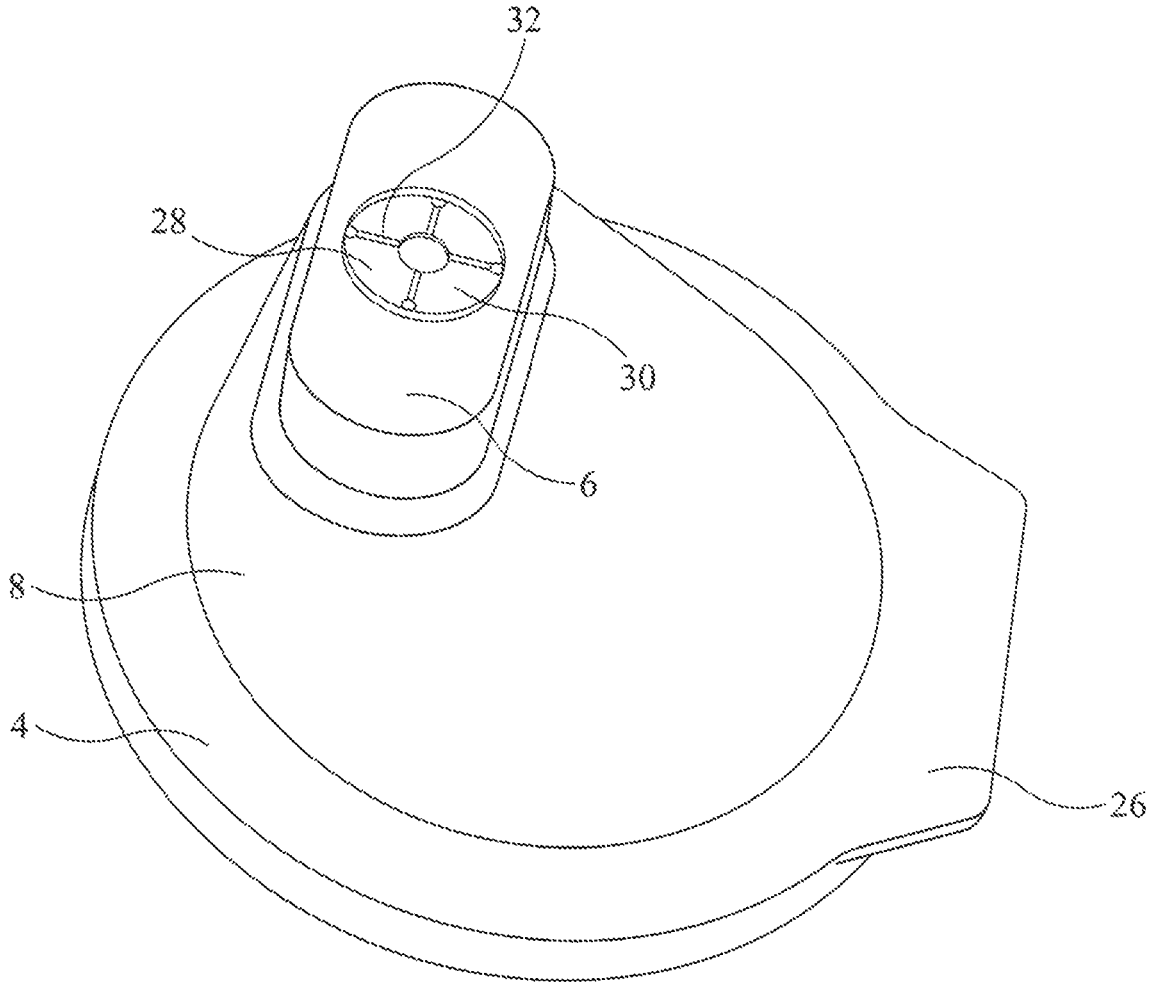
FIG. 4 depicts a top perspective view of the preferred embodiment of the device of the present invention.

In the drawings, one embodiment of the invention is illustrated by way of example. It is to be expressly understood that the description and drawings are only for the purpose of illustration and as an aid to understanding, and are not intended as a definition of the limits of the invention.

BACKGROUND OF THE INVENTION

In the painting industry, it is generally necessary to use a variety of paint product finishes or colours of paint in order to complete a job. Often, more than one product, finish or colour must be used in the same area, and at the same time.

A paintbrush will be damaged if it is left to dry loaded with paint, if the ferrule of the brush is immersed in paint, or if the bristles of the brush are left to sit in the bottom of a paint can or pressed against the side of the can. As a result, at present painters need to wash each brush once they stop painting with one product, finish, or colour before switching to a second, even if they will be returning to the first later in the paint job. In addition, brushes would need to be washed if work is interrupted due to a lunch or coffee break, or between work days. Often such frequent brush washing does not occur. Rather, brushes which are in use are usually wrapped with polyurethane plastic for short or long-term brush preservation. This requires use of large quantities of polyurethane plastic, increasing the cost of a job, as well as the environmental waste.

It would be desirable to develop means for suspending a paintbrush in a can of paint product in a position in which the ferrule and handle are above the level of the paint product and the bristles are immersed in the paint product while not touching the sides or bottom of the can. The present invention achieves these results.

SUMMARY OF THE INVENTION

There is provided a paint brush suspension lid for a paint can comprising a base having a first opening and means for sealing the base to the upper edge of an open paint can; a top having a second opening and a paint brush housing; an eccentric conical body extending between the top and base; and a resilient brush holder insert within the second opening, the insert having a resealable perforation.

The means for sealing the annular base may comprise an inverted rectangular channel extending along the perimeter of the first opening having a width marginally wider than the width of the side of a paint can. The channel may have inner and outer parallel annular walls, and the inner wall may extend lower than the outer wall. The inner wall may have a lower perimeter lip extending to the interior wall of the paint can.

The lid may also have a release tab extending horizontally from the lower perimeter of the base at a position opposite the top opening. The lid preferably is manufactured of a high visibility material in a bright colour such as bright yellow or orange.

The body of the lid may include a transparent or translucent window.

There is further provided a paint brush suspension lid with an annular base having a first opening; an annular top having a second opening, a sidewall extending continuously between the first and second opening; a resilient circular brush holder insert reversibly insertable into the second opening, the insert having a resealable perforation; a lid reversibly attachable over the second opening, the lid having an attachment ring attachable to the lid; an insertable securing ring reversibly insertable into the second opening above the insert and attachment ring; and means for sealing the annular base to the upper circular edge of a paint can, wherein the lid has a circular horizontal cross-section which decreases in diameter from the base to the top.

The second opening preferably is non-concentric with the first opening. The insert may be manufactured of urethanized rubber. The lid may have an annular bottom seat recessed into the second opening for supporting the insert and securing ring. There may be a transparent window in the sidewall of the lid of this embodiment.

DESCRIPTION OF THE INVENTION

As depicted in FIGS. 1-4, there is provided a reusable, sealable lid 2 for a paint can incorporating a self-sealing brush holder. In the preferred embodiment, the lid includes a base 4 comprising can sealing means; a top 6 comprising brush suspension means; and an eccentric conical body 8 extending between the base of the lid and the top of the lid.

In a preferred embodiment of the invention, the sealing means is an inverted rectangular channel 10 having an internal width marginally greater than the width of the sidewall of a paint can. Channels of different widths, to correspond to paint cans having sidewalls of different widths, are understood to be within the scope of the invention. The channel comprises inner 12 and outer 14 walls, the inner wall positionable adjacent the inside of the paint can sidewall, and the outer wall positionable adjacent the outside of the paint can sidewall. The inner wall of the channel may extend lower than the outer wall and have a lower perimeter lip 16 extending towards the inner sidewall of the paint can to form a strong seal between the lid and the paint can in order to prevent spillage of paint product when in use.

The lid is manufactured of a resilient material which permits the sealing means to function even on a used cut can with dry paint build up around the top of the can where excess paint is commonly cleared from the brush.

Preferably, the lid has a generally eccentric conical shape resulting in a top opening 18 non-concentric with the base opening 20. This off-centre positioning of the top opening allows a brush 22 to be suspended within the lid while permitting unobstructed use of the paint can handle 24. The lid also preferably includes a release tab 26 extending outwardly from the perimeter of the base, at a radial position along the edge of the lid opposite the top opening. Preferably, the release tab is of sufficient area to permit placement of visible branding thereon.

In the preferred embodiment of the invention, the top comprises a cylindrical brush housing having an oblong horizontal cross-section, with an opening 28 at its centre. A port insert brush holder 30 is positioned within the opening. The port insert allows for any size of brush handle and closes around the handle for an effective temporary seal. Preferably, the port insert brush holder is manufactured of a durable, resilient material such as urethanized rubber, with a perforation 32 cut through in a central position. Other durable, resilient materials are also possible. In a preferred embodiment, the perforation may be in the shape of an 'x' at the centre of the insert, with expanded sections along the perforation to permit entry and egress of a paint brush handle into the brush holder.

The material of the insert is of sufficient thickness and strength as to remain in a horizontal position in the opening of the lid in the absence of a brush handle, thereby reducing exposure of the paint product to the ambient air. When a brush handle is inserted through the perforation, the insert is sufficiently resilient as to maintain the brush in a static vertical position within the insert, thereby keeping the bristles straight and the cuticles sharp while keeping the bristles wet and soft for their next use.

The vertical position of the brush is easily adjustable as the level of paint product in the can changes, including for use with a full gallon can of paint.

In the preferred embodiment, the lid of the present invention is manufactured of a high visibility material in a bright colour, such as bright yellow or orange. The bright colour and conical shape of the device when in use convey the impression of a caution cone, thereby alerting workers of the location of the in-use paint can to avoid accidental spillage.

Figure 5:
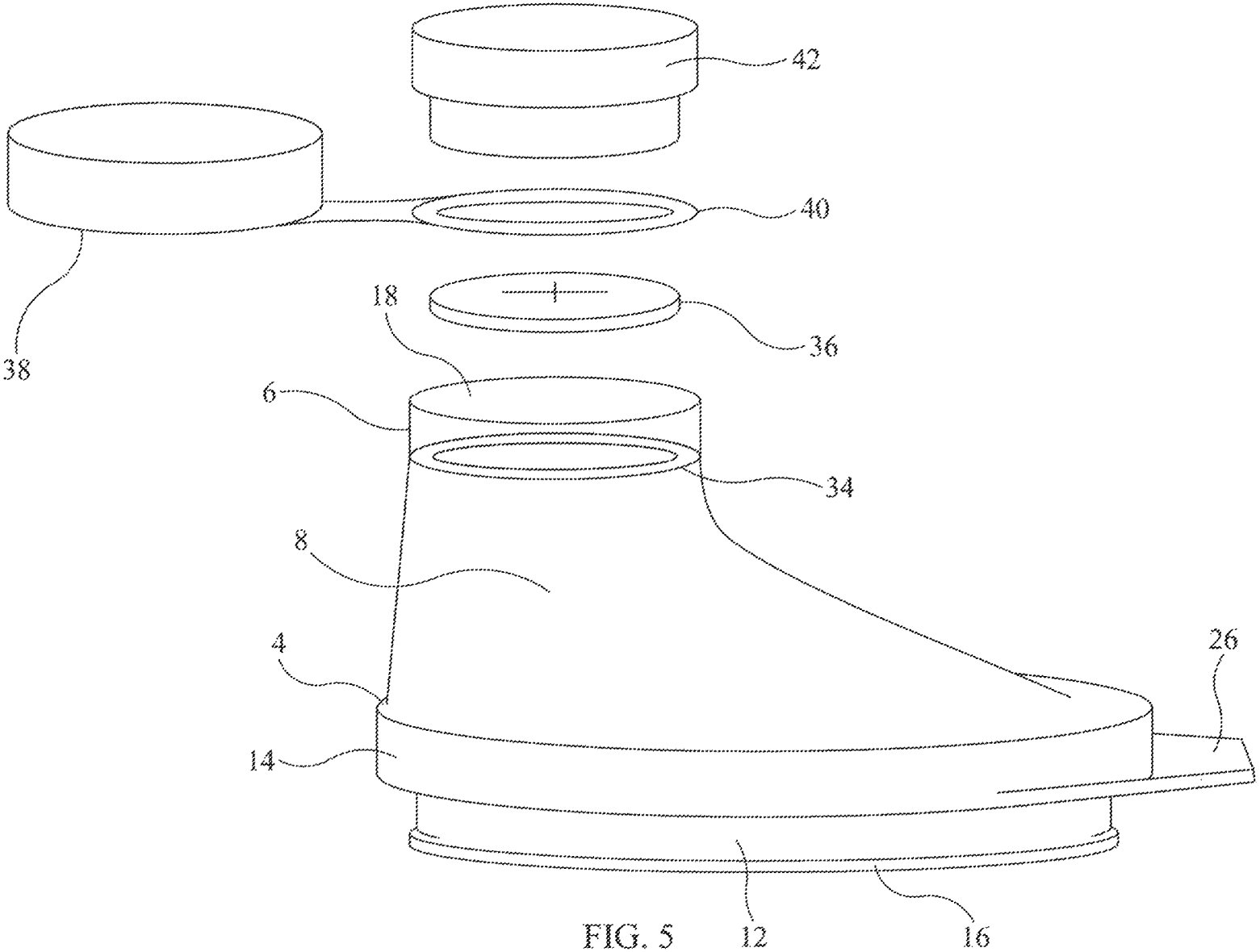
FIG. 5 depicts an exploded perspective view of a second embodiment of the device of the present invention.
Figure 6:
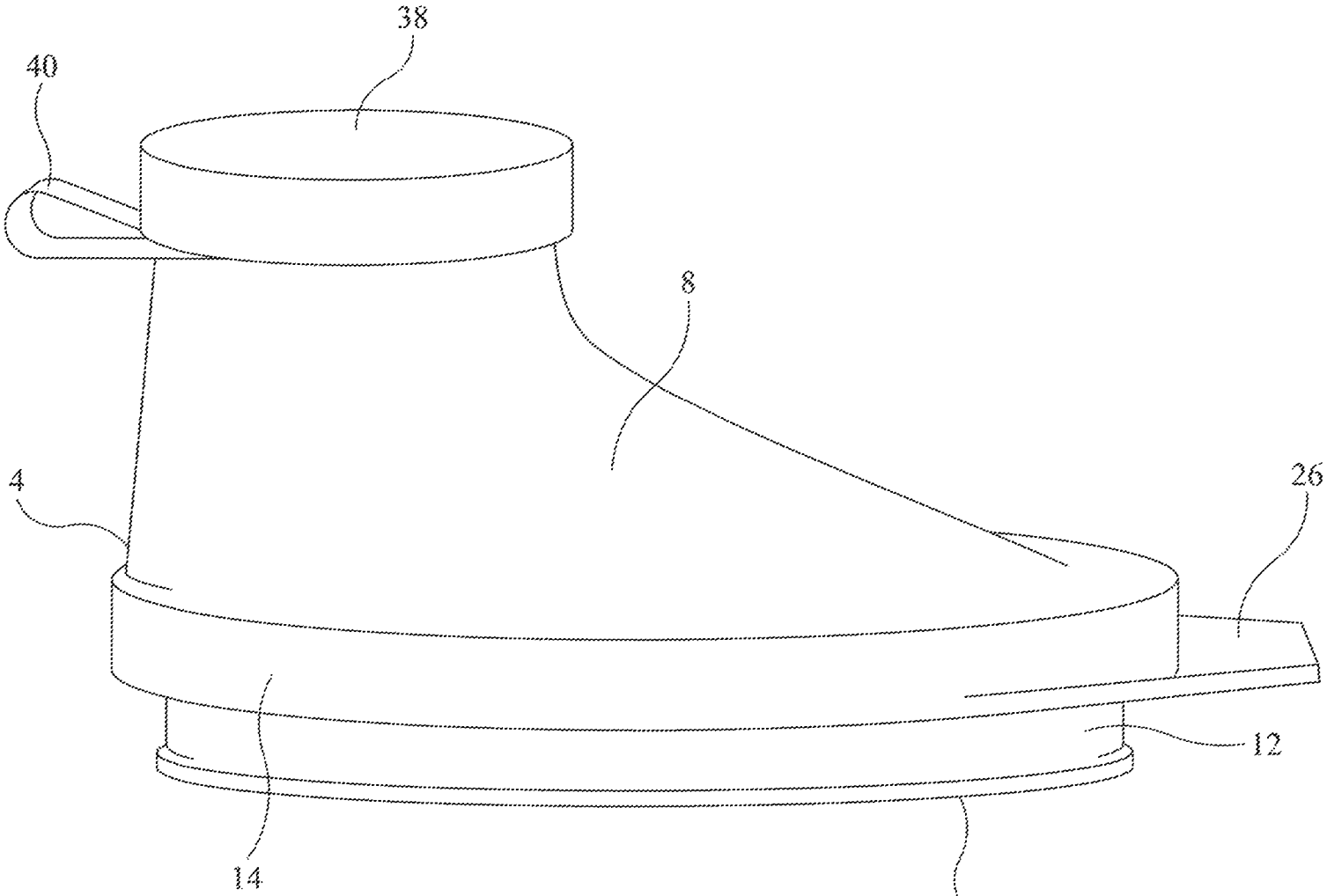
FIG. 6 depicts a perspective view of the second embodiment of the device of the present invention showing the lid closed.
Figure 7:
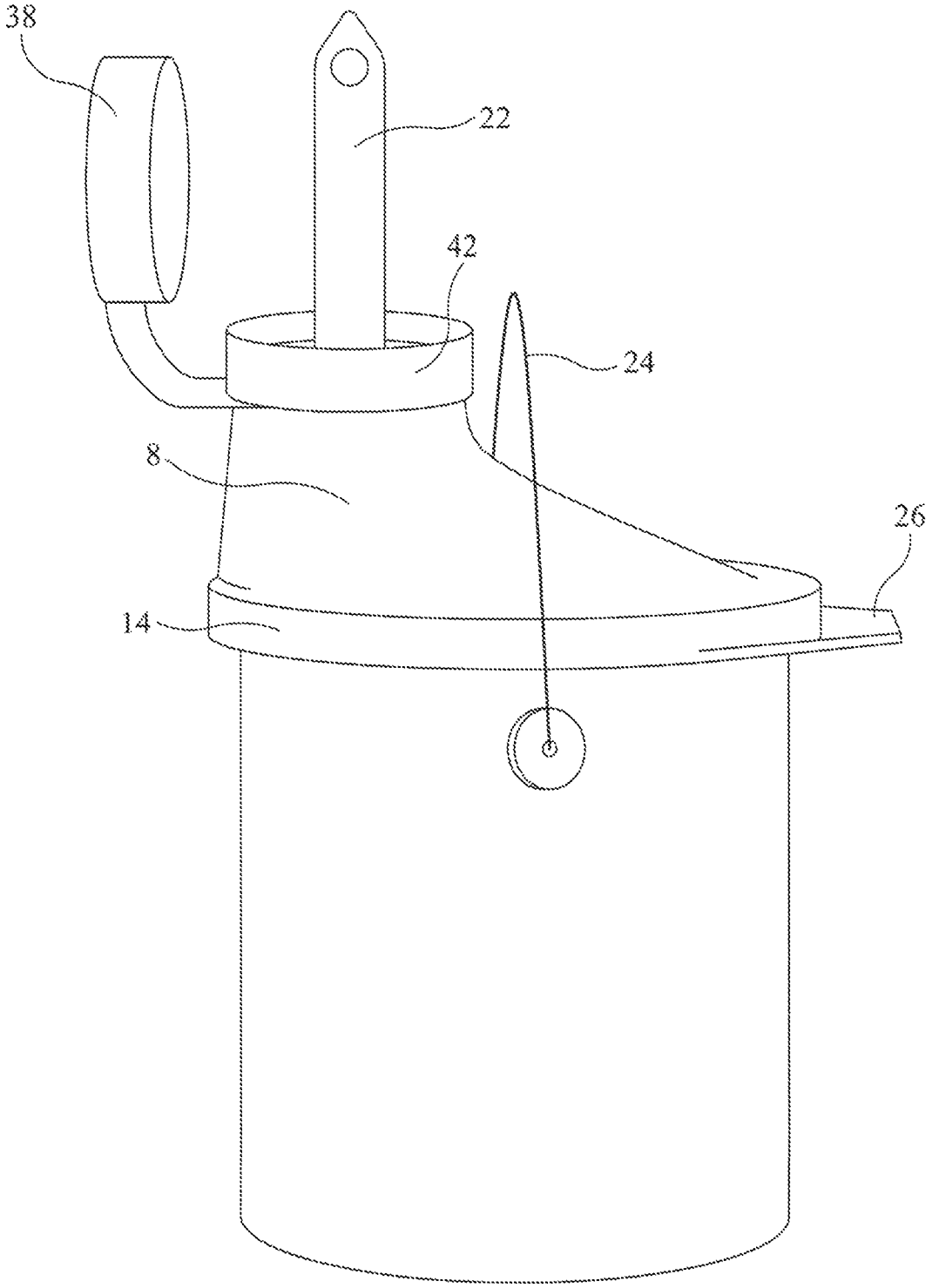
FIG. 7 depicts a perspective view of the second embodiment of the device of the present invention attached to a paint can with lid open and brush inserted.
Figure 9:
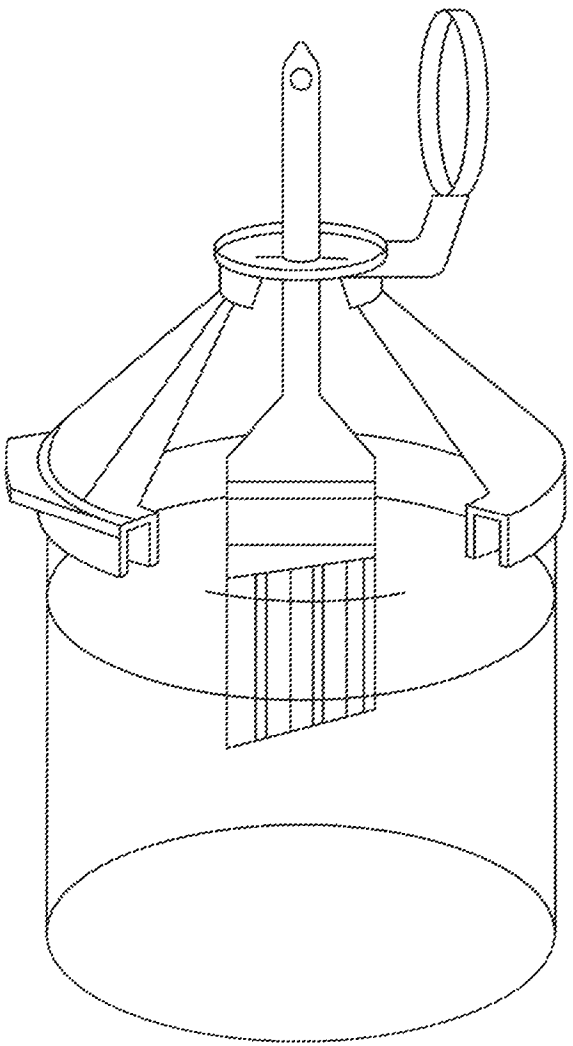
FIG. 9 depicts a cutaway view of the third embodiment of the device of the invention attached to a paint can, with an inserted paintbrush.
Figure 8:
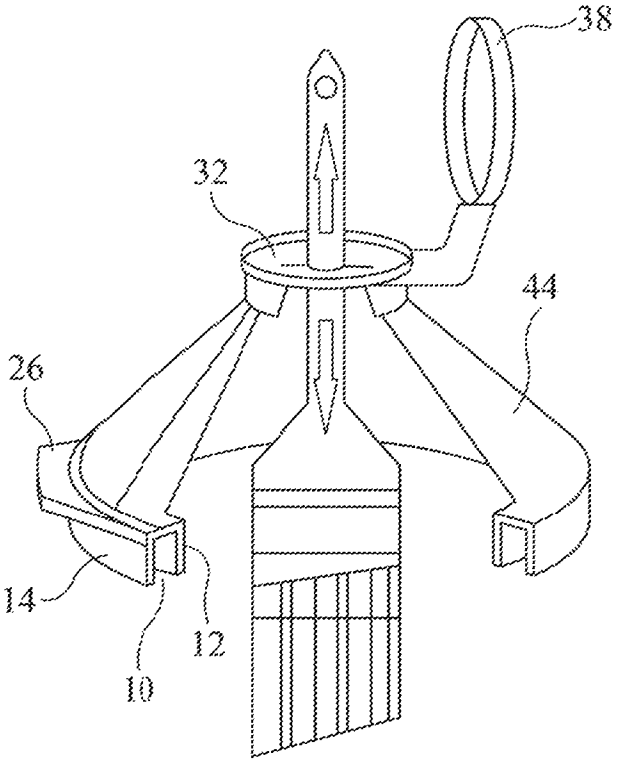
FIG. 8 depicts a cutaway view of a third embodiment of the device of the present invention, with an inserted paintbrush.
Figure 11:
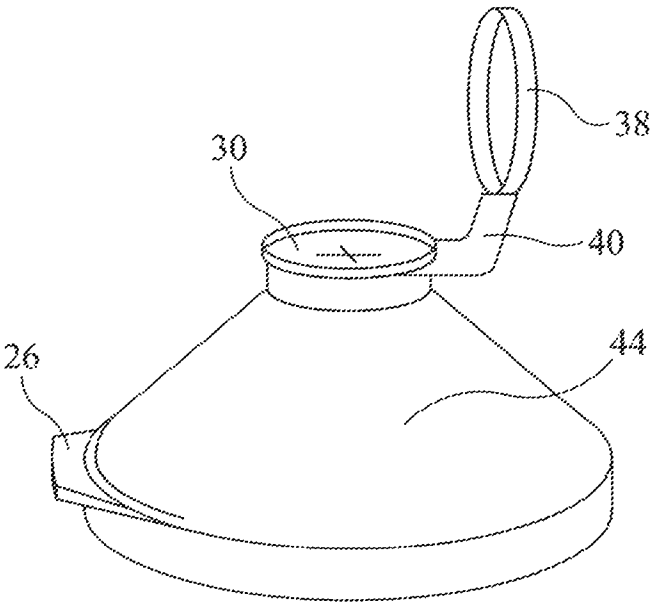
FIG. 11 depicts a perspective view of the third embodiment of the device of the present invention with the lid open.

According to a second embodiment of the present invention, as depicted in FIGS. 5-7, the lid may further comprise a bottom seat 34 recessed into the top opening 18 for receiving a self-sealing port insert brush holder; a self-sealing port insert brush holder 36; a cap 38 having an attachment ring 40; and a securing ring 42 for securing the port insert brush holder and cap attachment ring to the lid. Other enclosure means are also possible and are within the scope of the invention.

As depicted in FIGS. 8-13, there is provided a third embodiment of the invention. According to this third embodiment, the body of the lid is a concentric cone 44, with the top and bottom openings centred over the opening of the paint can. The lid comprises circular sealing means along its lower perimeter; a concentric conical sidewall extending upwardly from the circular seal to a brush holder port insert having a flexible sealing membrane 46; a release tab extending outwardly from a position above the seal at the base of the sidewall; and a cap reversibly attachable adjacent the port insert brush holder.

Figure 13:
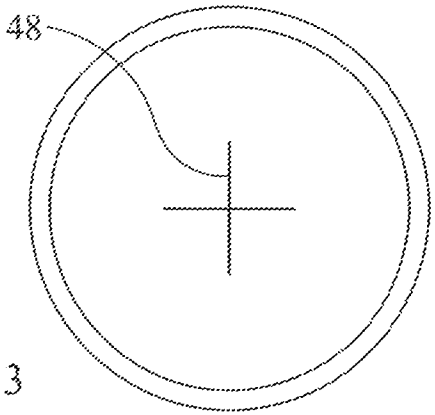
FIG. 13 depicts a top view of the port insert brush holder of the third embodiment of the device of the present invention showing perforation extensions in the membrane.
Figure 10:
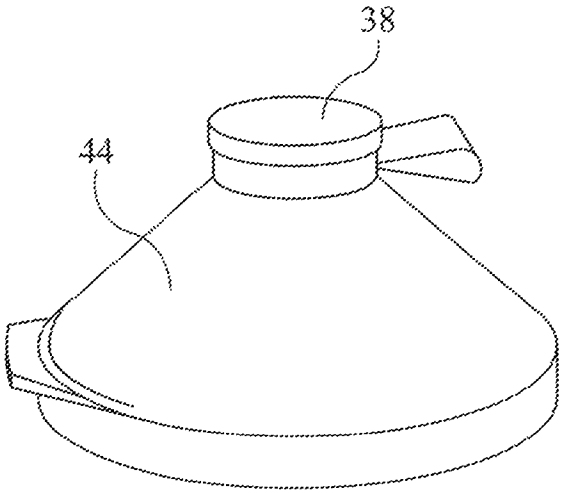
FIG. 10 depicts a perspective view of the third embodiment of the device of the present invention with the lid closed.
Figure 12:
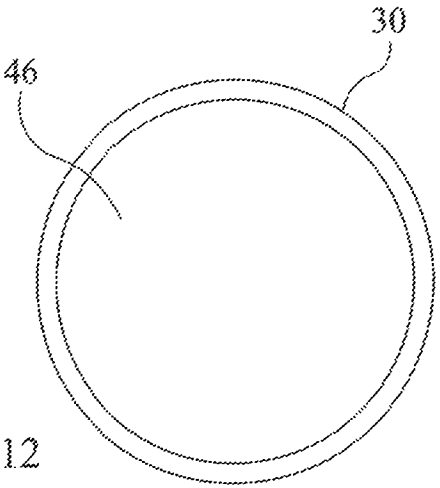
FIG. 12 depicts a top view of the port insert brush holder of the third embodiment of the device of the present invention.

As shown in FIG. 13, surface grooves 48 may extend beyond the slits in the port insert to create a web-like orifice which forms a tight seal around the brush handle.

In operation, upon stopping painting due to colour change, break or other reason, the used paintbrush is inserted handle first through the lower side of the brush holder port insert as far as the brush will allow. The lid, bearing the used brush, is then placed over the rim of the paint can and attached to the paint can by applying pressure over the sealing means, resulting in insertion of the paint can upper rim into the channel of the sealing means. Removal of the lid of the invention may be achieved by applying upward pressure to the release tab.

Once the lid is securely in place, the brush is lowered into a desired position by pushing the handle towards the bottom of the paint can until all of the bristles are immersed in the remaining paint without touching the base or walls of the paint can, while the ferrule and brush handle remain clear of the paint.

In one embodiment, the sidewall of the lid may be transparent or translucent to permit observation of the paint level and brush insertion. Alternatively, a transparent or translucent window may be located in the sidewall of the lid.

The height of the port insert above the seal is sufficient to ensure that even for a full can of paint, the ferrule and brush handle will remain above the level of paint in the can. The location of the top opening adjacent the edge of the lid permits a user to carry a paint can by a central handle while the lid is installed, as the top of the lid will not obstruct the users hand as it grasps the can handle.

In an alternate method of use, the brush position may be set prior to attachment of the lid on the basis of observation of the paint level while holding the lid bearing the brush adjacent the paint can.

The lid of the present invention may also be used to suspend a paint brush in a can of hot water prior to cleaning, or in paint thinner or mineral spirits in a manner which contains the fumes of these highly volatile materials.

There are several advantages provided by the present invention. By reducing the need for frequent brush washing and by preserving paint product better, the amount of clean water, waste water, paint thinner, paint, polyurethane plastic, varnishes, and solvents is greatly reduced. Additionally, the amount of time and effort required for completion of a paint job is reduced due to the reduction in brush washing time. Equipment costs are also reduced as brushes suffer less wear due to reduced washing, brush bristles are maintained in better condition by remaining wet with paint for longer periods, and paint product is less exposed to ultraviolet radiation and ambient air.

The present invention reduces the amount of time a user must spend wrapping brushes, permitting more efficient use of break times for workers and additional time for carrying out other tasks at a work site. Efficiency at a work site is also gained by enabling workers to leave brushes in paint products overnight for ease of pack up at the end of a work day and start up at the beginning of the next day.

The present invention is well suited for use of paint product in a lift basket where space is limited, while keeping product temporarily sealed and free of risk of debris contamination, with brushes securely suspended in the paint product.

The invention permits preservation of brushes and paint products while users are taking a break, when switching between different paint colours for a job involving multiple colours, for preventing dust and debris from entering the paint product, and when putting a project on hold.

As many possible embodiments may be made of the invention without departing from the scope of the claims, it is to be understood that all matter herein set forth or shown in the accompanying drawings is to be interpreted as illustrative and not in a limiting sense.

It will be appreciated by those skilled in the art that other variations of the preferred embodiment may also be practised without departing from the scope of the invention.

The invention claimed is:

1. A paintbrush suspension lid tor a paint can comprising:

an annular base having a first opening;

an annular top having a second opening, a sidewall extending continuously between the first and second opening;

a resilient circular brush holder insert reversibly insertable into the second opening, the insert having a resealable perforation for selectively positioning therein a paint brush handle;

a cap reversibly attachable over the second opening, the cap having an attachment ring attachable to the lid;

a securing ring reversibly insertable into the second opening above the insert and attachment ring; and means for sealing the annular base to the upper circular edge of a paint can, wherein the lid has a circular horizontal cross-section which decreases in diameter from the base to the top, further comprising a bottom seat recessed, into the second opening for supporting the insert and securing ring.

2. The lid of claim 1, wherein the insert is manufactured of urethanized rubber.

3. The lid of claim 1, wherein the sidewall of the lid fu her comprises a transparent window.

4. The lid of claim 1, wherein the second opening is non-concentric with the first opening.

5. The paint can lid of claim 1, wherein the perforation is concentric with the second opening.

6. The lid of claim 1, wherein the means for sealing the annular base comprises an inverted rectangular channel extending along the perimeter of the first opening having a width marginally greater than the thickness of the sidewall of a paint can.

7. The lid of claim 6, wherein the channel further comprises inner and outer parallel annular walls.

8. The lid of claim 7, wherein the inner wall extends lower than the outer wall.

9. The lid of claim 8, wherein the inner wall further comprises a lower perimeter lip projecting inwardly to the interior sidewall of the paint can.

10. The lid of claim 1, further comprising a release tab extending horizontally from the lower perimeter of the base at a position opposite the top opening.

* * * * *